US007922642B2

(12) United States Patent
Beck et al.

(10) Patent No.: US 7,922,642 B2
(45) Date of Patent: Apr. 12, 2011

(54) DEVICES AND METHOD FOR FEEDING AT LEAST ONE MATERIAL WEB OR WEB STRAND INTO A FOLDING DEVICE

(75) Inventors: Peter Franz Beck, Karlstadt (DE); Thomas Schreck, Birkenfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 407 days.

(21) Appl. No.: 11/992,393

(22) PCT Filed: Jul. 27, 2006

(86) PCT No.: PCT/EP2006/064710

§ 371 (c)(1),
(2), (4) Date: Mar. 21, 2008

(87) PCT Pub. No.: WO2007/033848

PCT Pub. Date: Mar. 29, 2007

(65) Prior Publication Data

US 2009/0108043 A1 Apr. 30, 2009

(30) Foreign Application Priority Data

Sep. 21, 2005 (DE) ..... 10 2005 045 041

(51) Int. Cl.
*B31B 49/00* (2006.01)

(52) U.S. Cl. ..... 493/362; 493/356; 493/410

(58) Field of Classification Search ..... 493/362, 493/356, 410

See application file for complete search history.

(56) References Cited

U.S. PATENT DOCUMENTS

| | | | | |
|---|---|---|---|---|
| 3,125,335 | A | 3/1964 | Becker | |
| 4,063,505 | A | 12/1977 | Sasamoto et al. | |
| 4,598,850 | A | 7/1986 | Winterholler et al. | |
| 5,211,280 | A * | 5/1993 | Houde | 198/836.3 |
| 5,263,414 | A * | 11/1993 | Lehrrieder et al. | 101/228 |
| 5,396,982 | A * | 3/1995 | Wicha | 198/494 |
| 6,269,751 | B1 * | 8/2001 | Hauck et al. | 104/106 |
| 7,066,368 | B1 * | 6/2006 | Ruckmann et al. | 226/74 |
| 7,387,601 | B2 * | 6/2008 | Beck et al. | 493/254 |

FOREIGN PATENT DOCUMENTS

| | | |
|---|---|---|
| DE | 33 12 038 A1 | 12/1983 |
| DE | 42 10 190 A1 | 9/1993 |

(Continued)

*Primary Examiner* — Hemant M Desai

(74) *Attorney, Agent, or Firm* — Jones, Tullar & Cooper, P.C.

(57) ABSTRACT

A device is usable to feed at least one material web and/or at least one strand that is comprised of several material webs into a folding device. A superstructure is part of the device, as is a former that can be displaced in relation to the material web, and a transverse cutter which is usable to separate the material web or webs into individual products. At least one guide rail is provided in the superstructure and carries a retaining device that can be displaceably guided on the path of travel of the material web through the superstructure. A leading edge of at least one of the material webs can be attached to the retaining device. The guide rail passes the former and includes at least one flexible guide rail section whose form can be altered. In particular, the length of the flexible guide rail section can be adjusted in the region adjoining the former.

43 Claims, 11 Drawing Sheets

FOREIGN PATENT DOCUMENTS

| | | | |
|---|---|---|---|
| DE | 44 09 693 | C1 | 9/1995 |
| DE | 197 58 468 | A1 | 11/1998 |
| DE | 100 38 551 | A1 | 2/2002 |
| DE | 101 28 821 | A1 | 1/2003 |
| DE | 10 2004 022 541 | | 12/2005 |
| EP | 0 383 515 | A2 | 8/1990 |
| EP | 0 544 088 | A1 | 6/1993 |
| EP | 0 553 740 | A1 | 8/1993 |
| EP | 0 673 764 | A1 | 9/1995 |
| GB | 2 331 984 | A | 6/1999 |
| WO | WO 98/50234 | A1 | 11/1998 |
| WO | WO 00/56646 | A1 | 9/2000 |
| WO | WO 00/56652 | A1 | 9/2000 |
| WO | WO 2004/056686 | A1 | 7/2004 |
| WO | WO 2005/092614 | A2 | 10/2005 |

* cited by examiner

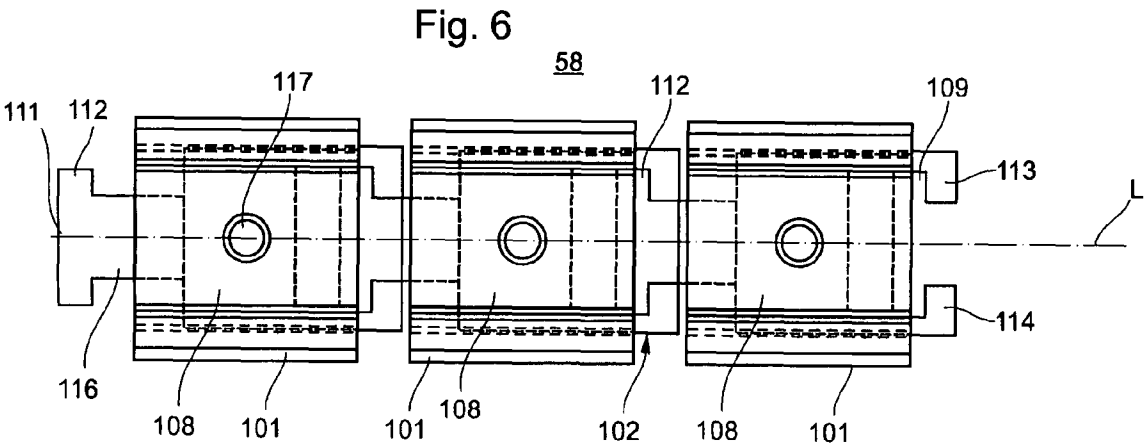
Fig. 6
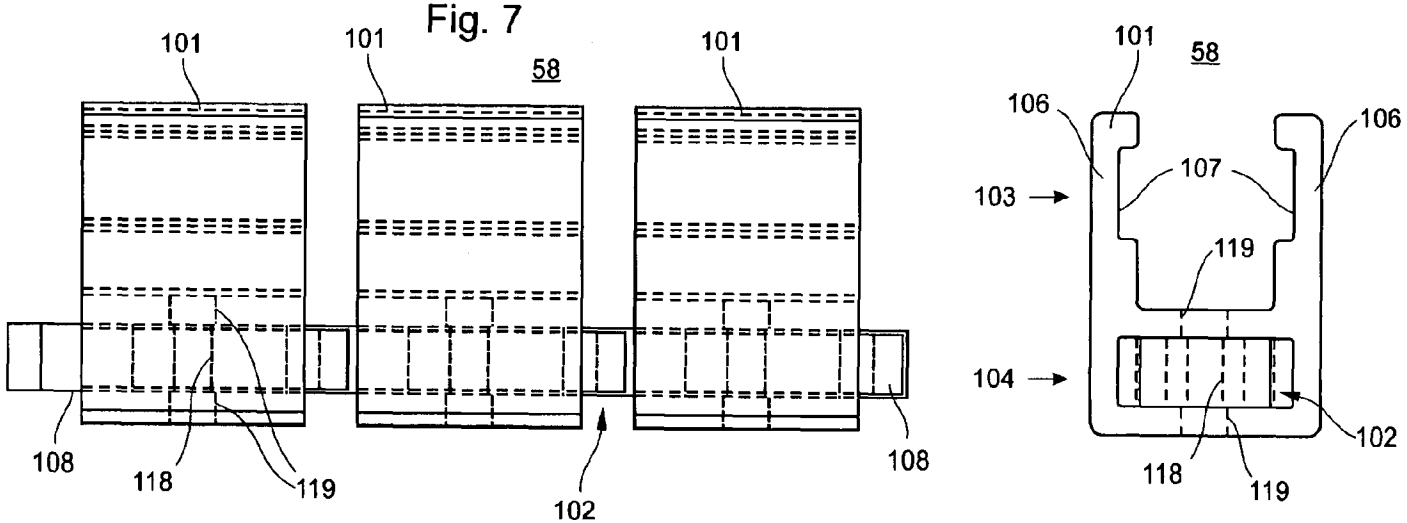
Fig. 7
Fig. 8

DEVICES AND METHOD FOR FEEDING AT LEAST ONE MATERIAL WEB OR WEB STRAND INTO A FOLDING DEVICE

CROSS-REFERENCE TO RELATED APPLICATIONS

This application is the U.S. national phase, under 35 USC 371, of PCT/EP2005/064710, filed Jul. 27, 2006; published as WO 2007/033848 A1 on Mar. 29, 2007 and claiming priority to DE 10 2005 045 041.5, filed Sep. 21, 2005, the disclosures of which are expressly incorporated herein by reference.

FIELD OF THE INVENTION

The present invention is directed to devices and to a method for drawing-in at least one web of material, or at least one continuous web, into a folding apparatus. The folding apparatus has a superstructure and at least one former. At least one guide rail, along which the draw-in device travels, is located along the former.

BACKGROUND OF THE INVENTION

A folding apparatus, such as the one which is known from WO 00/56652 A1, is comprised of a superstructure, in which paper webs, which have been fed from one or from several printing groups, are brought together, are possibly longitudinally cut and placed on top of each other. At least one former, in which a continuous web, that is combined in the superstructure from one or several paper webs, is longitudinally folded, and a transverse cutting arrangement, in which the longitudinally folded continuous web is separated into individual products are part of the superstructure. Often, the transverse cutting device is configured as a rotating cutter cylinder, whose cutters work together with a thrust element on a gripper or on a folding blade cylinder to sever the continuous web. The grippers of this gripper or folding blade cylinder maintain the products, which have been cut apart by the transverse cutting device, fixed to the surface of the gripper or folding blade cylinder and convey them to a transfer gap located between the folding blade cylinder and a folding jaw cylinder. There, a folding blade extends out of the folding blade cylinder in order to introduce the product held thereon along a center transverse line into a folding jaw of the folding jaw cylinder and to fold it transversely in this way.

To draw a paper web for the first time into a printing press, it is known, from EP 0 553 740 B1, to use a holding element in the form of a rail-guided chain link element, to which holding element the leading edge of the web to be drawn in, which leading edge has been torn off obliquely, is fastened. The guide rail extends next to the intended path of travel of the web through the printing press as far as the superstructure of a folding apparatus.

At the folding apparatus, the web is taken over by a draw-in device which is configured in the form of two spike-covered belts, as described in connection with the previously mentioned WO 00/56652 A1. Spikes of these belts spear the web along its lateral edges and pull it over an insertion roller at the upper edge of the former, as well as over the former itself.

The pulling elements, which are independent of the guide rail and the holding element conducted on it are the elements provided on the former. It is thus achieved that, in accordance with the respective width of the webs to be processed, the former can be displaced in such a way that a web, which was folded on the displaceable former, enters the transverse cutting device exactly in the center of the cutting device. This is of importance for an interference-free functioning of the transverse cutting device, and is in particular, important for the proper operation of the downstream-connected transverse folding device.

DE 42 10 190 A1 discloses a cutting device with an integrated shunt. The cutting device is arranged between draw-in rollers and folding cylinders.

DE 101 28 821 shows a device for bringing paper webs together in the course of the webs being drawn in.

U.S. Pat. No. 3,125,335 discloses a device for drawing in webs of material, by the use of belts.

EP 0 673 764 A discloses a device for drawing webs of material to be imprinted in over turning bars. Partial webs to be imprinted are drawn in using draw-in tips fastened on lateral sheet chains extending in guide rails.

A former device is known from WO 2004/056686 A1. The former or formers is or are movable transversely to the running direction of the web of material, by the use of at least one actuating member, for matching different web widths.

A longitudinally variable guide rail element for a roller chain, which is usable as a draw-in device for a paper web, is known from WO 98/50234 A1.

Later published DE 10 2004 022 541 A1 shows an arrangement for drawing in a web along a longitudinal former.

DE 33 12 038 A1 discloses a device for drawing in webs of material into rotary printing presses by the use of a draw-in belt. The returning portion of the draw-in belt is conducted over a different pathway in contrast to the drawing-in portion.

Later published WO 2005/092614 A2 describes an arrangement for drawing a web of material into a folding apparatus with a former, a transverse cutting device, as well as a guide rail. The arrangement has a cutting device.

SUMMARY OF THE INVENTION

The object of the present invention is directed to providing devices and a method for drawing at least one web of material, or at least one continuous web, into a folding apparatus.

In accordance with the present invention, this object is attained by the provision of a folding apparatus having a superstructure with at least one former that is movable transversely to a web travel direction. A guide rail, for a web leading end gripping device of a web draw-in assembly, is situated adjacent the former. A subsequent guide rail section, of variable shape, is positioned downstream of the former. First and second cutting devices may be provided in the path of web travel and the guide rail can extend between the two cutting devices. A separate return rail can be provided to return the web leading end gripping devices to their initial position.

The advantages which can be achieved by the present invention consist, in particular, in that during each position change of the former, even when employing different widths of the web of material, because of which different web widths the position of the former must be changed to assure the correct operation of the folding apparatus, the operators need not manually adapt the course of the guide rail downstream of the former to the changed position. This is because the guide rail section is of variable shape, which is, in particular, changeable in length and can be curved.

Previously, in the utilization of a fixed mounting of the guide rail without a guide rail section of variable shape, if the former, or the frame supporting it, was to be displaced, the track of the guide rail was interrupted at the connection with the former. As a result, the continued draw-in of materials was no longer possible. Instead, the former frame needed to be moved back into its zero position for each draw-in process.

In the present, the guide rail track is automatically matched to the former position because of the variable-shape guide rail section. Thus, the draw-in process of a web of material is possible in any arbitrary position of the former. The guide rail section of variable shape equalizes an angular offset of the guide rail in the direction toward the machine center, as well as a longitudinal offset of the guide rail in the running direction of the web of material. It is thus possible to perform the draw-in in every position of the former.

In a preferred further embodiment of the present invention, the guide section of variable shape is composed on the one hand of a support strip of variable shape and, on the other hand, of guide elements supported by the support strip. It is thereby possible, on the one hand, to obtain the shape variability of the guide rail section exclusively on the basis of the support strip, and to manufacture the guide elements from another material, and in particular from a comparatively stiff material, such as metal, for example. On the other hand, it is possible to manufacture the guide elements from known guide rails, and in particular to use cut-to-size partial pieces of the guide rails of non-variable shape, which are otherwise employed in the press as guide elements.

The support strip of variable shape can be a homogeneous strip which is made of suitable plastic materials that can be elastically deformed to a certain extent, or of a caoutchouc or natural rubber material, by the use of which materials the curvature of the guidance arrangement in particular is achieved. To a certain extent, a variability of the length of the support strip can also be accomplished by the use of such deformable materials.

In a particularly preferred further embodiment of the present invention, it is provided that the guide strip includes a plurality of support elements which, when viewed in the longitudinal direction of the support strip, are arranged one behind the other. Adjoining ones of the support elements are coupled with each other, in particular at variable spacings, which can be advantageously achieved so that adjoining support elements engage each other with a degree of free play.

Such a preferred embodiment of the present invention facilitates a particularly large variability of the shape of the support strip, and therefore of the guide rail section of variable shape, and in particular a large variability in length. This large variability is primarily determined by the sum of the play between the individual adjoining support elements.

A particularly simple embodiment of a connection between the adjoining support elements results when the support elements engage each other such as, for example, by the provision of T-shaped shoulders, and corresponding openings in the respectively adjoining support elements with play. In an alternative embodiment, the adjoining support elements are coupled with each other via oppositely oriented coupling shoulders, and in particular by hook-shaped coupling shoulders.

Putting together a suitable support strip from individual support elements becomes particularly simple when the support elements, which are configured as discussed above can, for example, be brought into engagement with each other substantially perpendicularly with respect to the longitudinal direction of the guide rail section. To facilitate simple mounting of the guide elements on the support strip, or on the support elements, the guide elements are preferably embodied so that they can be pushed on the support strip or the support elements. In a preferred further embodiment of the present invention, it has been provided that the guide elements extend around the support elements, at least in the area of their coupling, so that, in this way, the coupling or the connection between two adjoining support elements is assured by the assigned guide element.

In order to be able to adapt the folding apparatus for use in the processing of continuous webs of different widths, and then to be able to conduct these continuous webs of different widths centered through the transverse cutting device and through the transverse folding device, the former can preferably be displaced in a direction parallel to the longitudinal axis of the transverse cutting device, as previously discussed. In order that the guide rail can follow a displacement movement of the former, a section of the guide rail, which is located upstream of the former in the running direction of the continuous web, should be stretchable or deformable. It has therefore been provided, in a preferred embodiment of the present invention, that the guide rail also has guide rail sections of variable shape, and in particular has a guide rail section of variable length, which is located not only downstream of the former, but which is also located upstream of the former. By the provision of this embodiment, the shifting of the frame supporting the former becomes possible without making the adaptation of the guide rail structure extending to the former necessary.

To assure a matching orientation of the holding elements traveling along the guide rail, and with respect to the web of material held on the guide rail, in the course of the passage of the web of material over the former, the guide rail is twisted, at the level of the former, preferably by approximately 90°.

In accordance with a further aspect of the present invention, it is possible to extend the guide rail to a position located, at the path of travel of the web of material between a first cutting device and a second cutting device. The first cutting device can be operated in a phase-correlated manner, and the second cutting device can be operated as an emergency stop. Devices for use in the automatic draw-in of the continuous web are no longer required on the other side of this position if, for example, after trimming off the not-imprinted waste material by the use of the phase-correlated cutting device, the usable portion of the continuous web enters into the emergency stop cutting device which is arranged after the phase-correlated cutting device, or into the transverse cutting device arranged after it, without requiring guidance by the use of the guide rail.

In the course of a draw-in process, a storage device, for use in receiving holding elements, and which is arranged in the extension of the guide rail between the first and second cutting devices on the other side of the former, permits the draw-in of several webs of material in rapid succession. This makes it not necessary, in the meantime, to move the holding element, used in the draw-in of a first web of material, back to its initial location in order to free the guide rail for allowing the passage of a holding element of a further web of material.

The storage device can be constituted, in a preferred embodiment, by a further guide rail section extending away from the web of material in the lateral direction over a curved section. The storage device is capable of receiving several, and preferably in receiving a plurality, of holding elements situated side-by-side in the holding device.

If required, a separating device, for use in separating individual holding elements from their respective webs of material, can be placed upstream of the storage device. The leading sections of each of the webs of material taken along by the individual holding elements need not also be received in the storage device if insufficient space for this receipt exists in the storage device.

Preferably, the guide rail can extend continuously from a roll changer of a printing group, which is located upstream of the folding apparatus, as far as into the folding apparatus. Or, the guide rail can extend as far as upstream of the emergency stop cutting device.

In accordance with a further preferred embodiment of the present inventor, at least one further return guide rail, which differs from the at least one draw-in guide rail, can be provided for use in returning the holding elements to their initial position after they have been used in the web draw-in process. This has the substantial advantage that, independently of the operation of the remainder of the installation, it is possible, at any time, to return the previously used holding elements to their origin via the at least one return guide rail.

It can be additionally practical to introduce a storage device for the temporary reception, or for the intermediate storage, of holding elements between the guide rails and the return guide rail.

In an alternative embodiment, it can be provided to omit a separate return guide rail and to return the previously used holding elements to an intermediate storage area in the storage device via the at least one guide rail over which these previously used holding elements had been drawn in. However, in connection with this structurally simpler embodiment of the present invention, a return of the holding elements can only take place if the guide rails are available for this.

BRIEF DESCRIPTION OF THE DRAWINGS

Preferred embodiments of the present invention are represented in the drawings and will be described in greater detail in what follows.

Shown are in.

DESCRIPTION OF PREFERRED EMBODIMENTS

Figure 1:
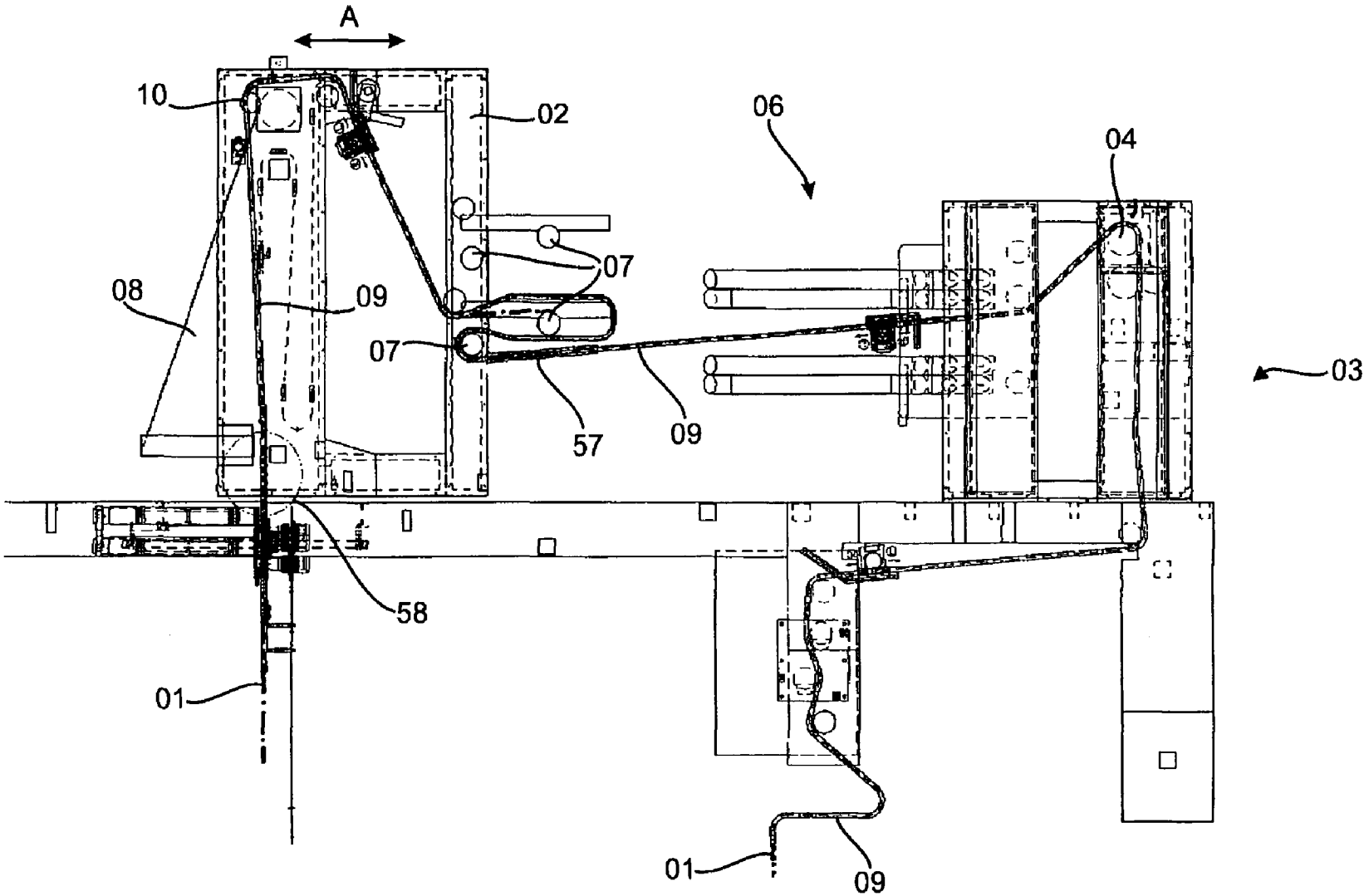
FIG. 1, a schematic side elevation view of a portion of a printing press with a draw-in device containing a guide rail, in FIG. 2, a schematic end view of the printing press in accordance with FIG. 1, in FIG. 3, a schematic partial end view, in accordance with FIG. 2, in which the guide elements are not represented, in FIG. 4, a detail view of a guide rail and of a holding element guided in the guide rail for engagement with a web of material to be drawn in, in FIG. 5, a perspective representation of a short section of a first preferred embodiment of a guide rail section of variable shape, in FIG. 6, a top plan view of the guide rail section in accordance with FIG. 5, in FIG. 7, a side elevation view of the guide section in accordance with FIG. 5, in FIG. 8, an end view of the guide rail section in accordance with FIG. 7, in FIG. 9, a perspective representation of a short section of a second preferred embodiment of a guide rail section of variable shape, in FIG. 10, a perspective plan view of a support element and of a guide element of the guide rail section in accordance with FIG. 9, in FIG. 11, a top plan view of the section is accordance with FIG. 9, in FIG. 12, a side elevation view of the section in accordance with FIG. 9, in FIG. 13, an endview of the section in accordance with FIG. 12, in FIG. 14, a top plan view of a third preferred embodiment of the guide rail section, in FIG. 15, a side elevation view of the third preferred embodiment in accordance with FIG. 14, in FIG. 16, a top plan view of a further preferred embodiment of a guide rail section of variable shape, and in FIG. 17, an advantageous embodiment of a chain.
Figure 2:
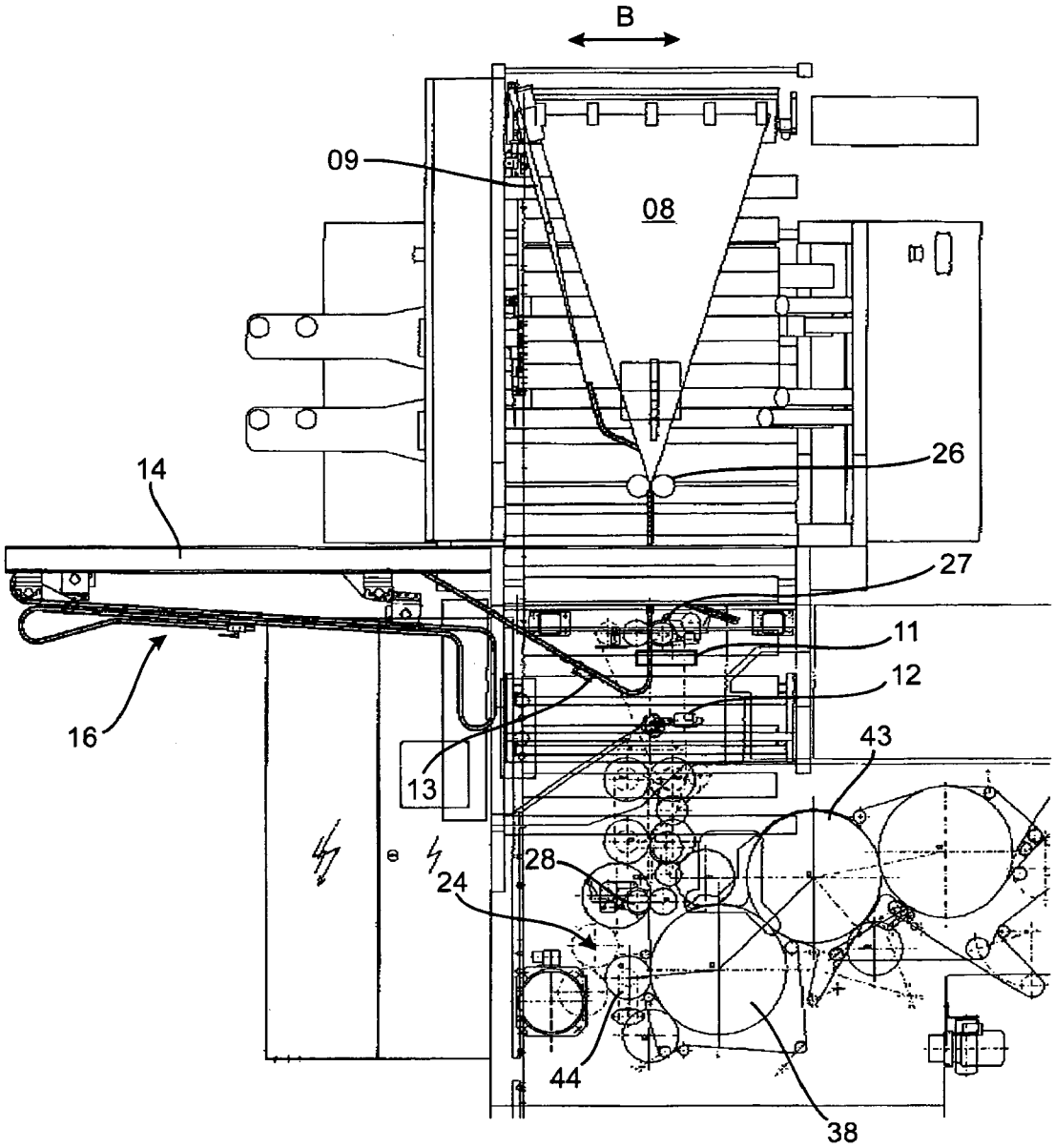

Referring initially to FIGS. 1 and 2, there is depicted a web of material 01, such as, for example, a paper web 01, coming from a printing group, which is not specifically represented, and arriving from the bottom right in the representation of FIG. 1. The paper web 01 exits the printing group and reaches a superstructure 03 of a folding apparatus. The superstructure 03 includes a longitudinal cutter 04 for use in separating the incoming paper web 01 into a plurality of side-by-side located partial webs. A turning deck 06, in which the partial webs of the paper web 01, and possibly further, non-represented paper webs, are rearranged, are displaced transversely to the web running direction, which is from the right to the left in FIG. 1, and/or turned, and are then placed on top of each other is located after the longitudinal cutter 04. The path of the paper web 01 then extends from the turning deck 06, over an arrangement of equalization rollers 07 for web length compensation and traction control, to a former 08.

The former 08 and the equalization rollers 07 are movable in a lateral direction in FIG. 1 in a common frame 02, in the direction of web travel, as indicated by the two-headed arrow A in FIG. 1. It is furthermore possible for the former 08 to be displaced on the frame 02 transversely with respect to the direction of travel of the incoming paper web 01, as indicated in FIG. 2 by the two-headed arrow B.

Referring now to FIG. 2 and at the outlet of the former 08, the paper web 01 runs substantially vertically downward toward the bottom of the former 08 and through a first cutting device 11 and a second cutting device 12, and then through a transverse cutting device 24 and a transverse folding device, all of a generally conventional construction, which need not be explained in greater detail here. Traction groups 26, 27, 28 are provided for guiding the paper web 01 between the former 08 and the transverse cutting device 24, as may be seen in both FIGS. 2 and 3.

A guide rail 09 extends along the path of the paper web 01, as depicted in FIG. 1. Over its larger portion of its length, the guide rail 09 runs together with the paper web 01 in the representation in accordance with FIG. 1. However, guide rail 09 is, in actuality, arranged substantially at the side of the paper web 01 and is supported, with respect to the edge of the paper web 01, at a preset spacing. In a way, which will be described subsequently, the guide rail 09 is used for drawing a paper web 01 in through the machine into the folding apparatus. Preferably, the draw-in process of the web 01 through the printing groups, which are not specifically represented, and which are assigned to the web path takes place when these printing groups are not printing the web.

As can be seen by again referring to FIG. 2 in particular, the guide rail 09 extends along the former 08 and into the area between the first cutting device 11 and the second cutting device 12. From this area, the guide rail 09 is laterally moved out of the installation via a curved guide rail section 13 to a cross bar 14 and is formed into one or several loops. These loops define a storage device 16 for the holding elements, which will be described subsequently, which holding elements are conducted on the guide rail 09, and on which holding elements the leading end of a paper web 01 is fixed in place while being drawn in. Preferably, the guide rail 01 extends, without a break, from a roll changer in a printing group, which is not specifically represented in FIG. 1, and which is located upstream of the folding apparatus, as far as the holding elements storage device 16.

Adjoining the curved guide rail section 13, there may be provided a paper web leading end separating device, which is not specifically represented, and which releases the leading end or head section of each paper web 01 passing it from its holding element. Such a separating device can be arranged at the inlet to the storage device 16. The continuous web, which has become leaderless on the other side of the separating device, drops freely down beside the folding apparatus and is expelled in this way.

At the latest, after all of the holding elements have been released from the leading ends of their respective paper webs 01, a start is made to return them to their respective starting points. To insure that exactly one holding element is returned to each respective starting point, appropriate shunts, which are not specifically represented, are provided, whose settings are automatically controlled in order to convey each holding element back to a starting point which is assigned to it.

To accomplish the return of the holding elements to their initial starting points at the respective roll changers, it is possible to return the holding elements in the opposite direction along the same path they had taken in the course of drawing in the respective paper web 01.

In accordance with an alternative embodiment, an additional return guide rail is provided, over which the holding elements are conveyed back into their original positions. Such a return guide rail, which is not specifically represented in the drawings, can, for example, be connected to the end of the storage device 16. In this way, the holding elements are conducted in a cycle, so to speak. It would also be possible to do without a storage device 16, if such an additional return guide rail were provided, since the provision of a return guide rail permits the return of the holding elements at any time, regardless of the operational state of the machine.

As was previously discussed above, the end of the guide rail 09 is arranged between the first cutting device 11, which can, in particular, be a phase-correlated cutting device 11, and the second cutting device 12, the function of which can be an emergency stop cutting device 12, which will be explained in greater detail in what follows, and in particular while making reference to FIG. 3.

Figure 3:
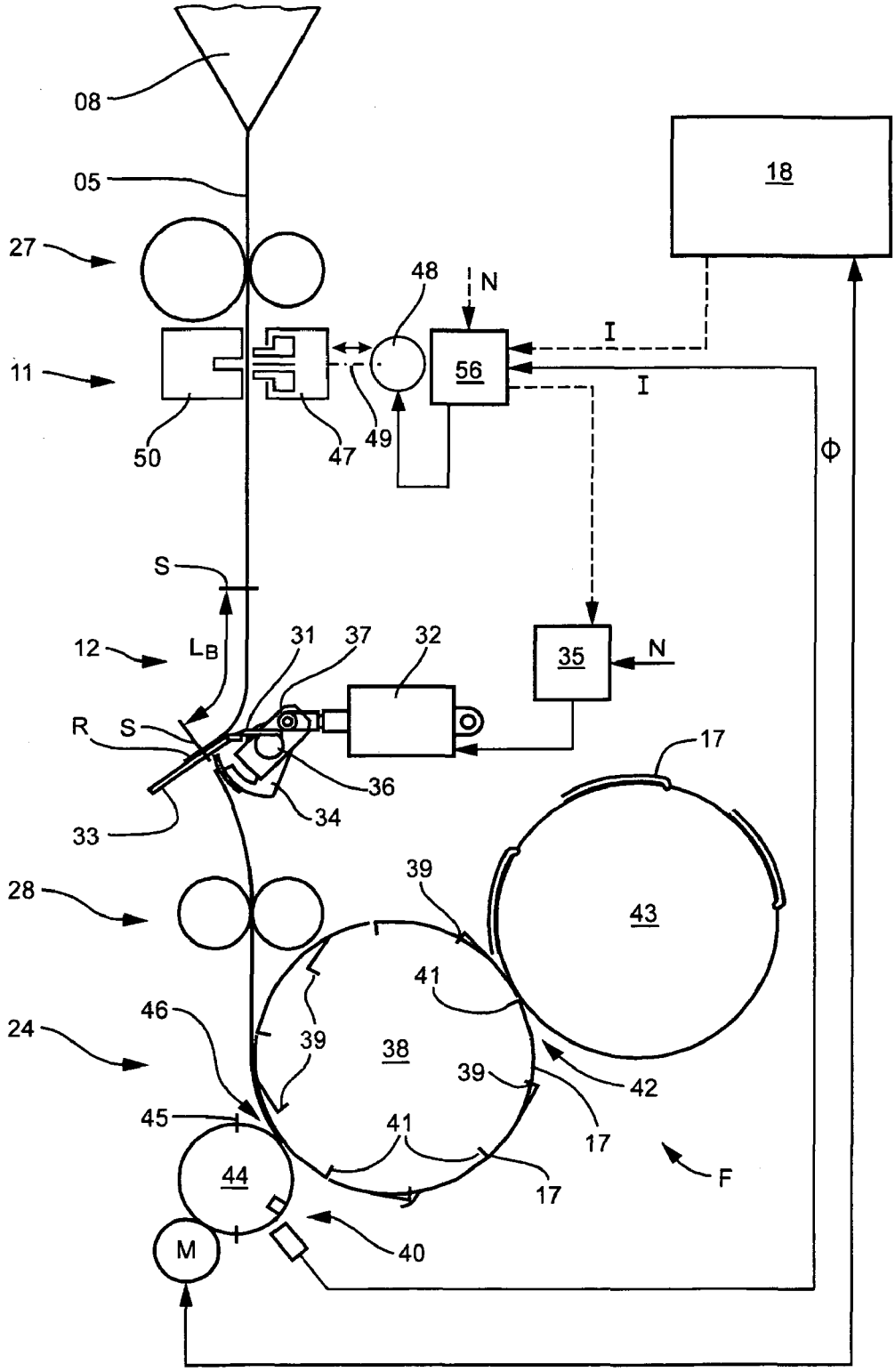

The web of material 01, and in particular the paper web 01, contains a pattern to be processed, such as, for example, a print image, which reappears after a defined repetition length $L_B$, as depicted in FIG. 3. In the further processing stage containing the folding apparatus F, also as depicted in FIG. 3, the web of material 01, or a continuous web 05 which is made of one or of several such webs of material 01, containing the repeated pattern to be processed, is cut into product sections 17, often referred to as signatures. As represented in FIG. 3, the folding apparatus F can include a transport cylinder 38, such as, for example, a gripper cylinder 38 embodied as cylinder 38 with grippers 39 and cutters 41, and a folding jaw cylinder 43, which works together with the transport cylinder 38 and defines a folding gap 42. The transport cylinder 38 works together with a cylinder 44, such as, for example, with a cutter cylinder 44, which supports cutters 45, so that the transverse cutting device 24 is formed.

The continuous web 05 is cut into product sections 17 matching the recurring repetition length $L_B$ in the transverse cutting device 24. To accomplish the making of a cut matching the repetition length $L_B$, the operating cycles of the transverse cutting device 24 and of a printing unit, which is not specifically represented, and which applies the pattern to be processed, such a printing unit being, for example, a printing group, are synchronized. If required, a path length of the web, or webs, from the printing unit to the location of the cut can be additionally set to a whole-number multiple of the repetition length $L_B$ by the use of a linear registration device, which is not specifically represented. If the printing unit and the transverse cutting device 24 are driven by a common drive motor, synchronization can take place by the use of mechanical coupling, or can take place electronically, in case of the printing unit and the transverse cutting device 24 being driven mechanically independently of each other by drive motors, preferably by the use of a virtual guide shaft. In this case, the virtual guide shaft is understood to be a component of a machine control device 18 that is indicated schematically in FIG. 3. Control device 18 can generate set point values Φ purely synthetically, on the basis of preset values with regard to the production speed, and can transmit these set point values to all of the drive mechanisms of the printing units to be synchronized, as well as for example to a drive mechanism M, which drives the transverse cutting device 24. However, the set point values Φ of the guide shaft, and therefore all of the remaining drive mechanisms, can also follow the position of the folding apparatus F, or of the transverse cutting device 24, for synchronization.

The cutting device 12 for use to accomplish the spontaneous cutting of the continuous web 05, such as, for example, as a result of an emergency stop, is arranged in the path of the continuous web 05 between the printing unit, which is applying the pattern to be processed, and the transverse cutting device 24. This emergency cutting device 12 is configured to cut through the continuous web 05 with a short reaction time and upon receipt of an appropriate command and, in an advantageous further development, to simultaneously conduct the now cut, continuous web 05 out of the continuous web path, in the direction toward the folding apparatus F. Basically, every cutting device 12, having a cutter 31 that can be moved into the continuous web path or out of the continuous web path, can be provided for this emergency web cutting and deployment.

In the preferred embodiment of the present invention, as depicted in FIG. 3, the emergency cutting device 12 has a cutter 31, which is pivotably seated on a shaft 36, and which can be moved into the continuous web path, or out of the continuous web path, by pivoting of the shaft 36. Pivoting of the shaft 36, and therefore movement of the cutter 31, takes place by the operation of a lever 37, which lever 37 is hinged eccentrically in respect to the shaft 36, by a pressure-medium-operated actuating device 32. Here, the actuating device 32 is operated as a result of a signal N, exemplifying an emergency stop, via a control device 35, or via an actuating member 35, which may be, for example, embodied as a valve for charging with a pressure medium. This signal N can come from the machine control device 18 or, for a short running time, can come directly from sensors for detecting errors. In an advantageous further development, the cutting device 12 may also have a guide element 33, such as, for example, a deflecting tongue 33 which, in the active state of the cutter 31, works together with the cutter 31, blocks the operational continuous web path and conducts the now severed continuous web 05 out of the normal, operational web travel path to the folding apparatus F. Furthermore, the cutting device 12 can have a strap 34, which can be pivoted together with the cutter 31 and which strap 34 aids the guidance of the start of the continuous web in the direction toward the folding apparatus 12 when the cutter 31 is deactivated.

If an error or fault occurs, in the course of the operation of the machine, in which circumstance the further run-in of the continuous web 05, or of the webs 01 of material into the folding apparatus F is to be prevented, the machine is stopped, for example, and the continuous web 05 is cut by the operation of the cutting device 12. In FIG. 3, this circumstance is indicated by the signal N acting on the actuating member 35.

This cutting, or "emergency cutting", takes place spontaneously and without considering a location, or a cutting line S, which is typically provided for the usual cutting step at one end or the other of a section length $L_B$ step in accordance with the typical operation of the device. The continuous web 05 is now moved laterally out during the braking of the installation. As represented in FIG. 3, in an operational state shortly following the first cutting, or the so-called emergency cutting, and since as a rule, the emergency cut does not coincide with the planned cut between two repetition lengths $L_B$, a rest or residual section, R of a length less than $L_B$ remains on the continuous web 05 and extends from the location of the emergency cut up to the start of the next repetition length $L_B$.

If the continuous web 05, now containing the rest or residual section R, were to be conducted to the folding apparatus F, cutting off of the rest or residual section R would take place as the first operational cut in the transverse cutting device 24, because of the synchronization with the repetition length $L_B$, which rest or residual section, because of its shortened length, could not be picked up by the gripper 39. If it is intended to avoid the risk of a further disruption caused by this residual section being mishandled by the gripper cylinder 38, it would be necessary to remove the rest or residual section R, in an elaborate manner, from the folding apparatus F.

To prevent this elaborate removal process, the emergency cutting device 12 is also programmed so that it can be triggered in response to the correct registration of the section $L_B$. In this case, cutting in response to the correct registration is to be understood as the cutting of a continuous web 05, or of webs of material 01, at a location at an operational cutting line S which is typically intended for accomplishing cutting between two successive repetition lengths $L_B$. Thus, in the course of the entry of the newly formed leading edge, at the start of the continuous web, newly formed by the operation of the emergency cutting device 12 in this way, which newly formed leading edge coincides with the operational cutting line S, into the transverse cutting device 24, this newly formed leading edge runs together with, or is aligned with the cutter 45 which cutter 45, in the course of the forward movement of the continuous web 05, is moved synchronously with respect to the newly formed leading edge into the effective cutting gap 46.

In the preferred embodiment which is depicted in FIG. 3, the first cutting device 11 has a cutting element 47, or a cutter 47, which extends perpendicularly, with respect to a linear extension of the continuous web 05, and parallel, with respect to the plane of the continuous web 05, and which cutter 47 is conducted, movable perpendicularly, with respect to the plane of the continuous web 05, on a linear actuating path. A displacement of the cutting element 47, and therefore of the associated cutter 47, takes place, for example, by the use of a pressure-medium-operated actuating device 48, such as, for example, a hydraulic or pneumatic cylinder 48 with a piston and tappet, and whose movement can be converted into the linear movement of the cutting element 47 by the utilization of a movement transfer mechanism 49, which can be a pivot lever mechanism 49 in particular. In the case of the preferred embodiment described above, the actuating movement of the actuating device 48, such as, for example, its piston and tappet, extends perpendicularly with respect to the actuating movement of the cutting element 47, because of which, the movement transfer mechanism 49, or of a pivot lever mechanism 49, is required. However, on the other hand, a space-saving arrangement is provided.

In an advantageous further development of the present invention, the cutting element 47, or the cutter 47, works together with an oppositely located further cutting element 50, or an abutment 50, which may be, for example, embodied as a counter-cutter 50 or as a cutting strip 50. The two cutting elements 47, 50 cooperate and form a cutting groove in the course of their working together. The counter-cutter or cutting abutment 50 is preferably arranged so that it is fixed in place on a side of the continuous web 05 opposite to the cutting element 47, but could also be movable, and in particular could be linearly movable, or could also itself be movable instead of the first cutting element 47, or the cutter 47 being movable.

The operation of the first cutting device 11 takes place in a phase-correlated manner with respect to the transverse cutting device 24. Triggering of the first cutting device 11, in accordance with the correct registration for the subsequent operational cut, i.e. triggering of the first cutting device 11 at the correct moment in regard to the forward moving continuous web 05, takes place based on a signal with respect to status information I regarding the operational transverse cutting device 24, such as, for example, the folding apparatus F, and in particular phase information I, referred to hereinafter as signal I, for short. In connection with a transverse cutting device 24 based on rotating cutters 45, this phase information I represents an angle information I of the cutter cylinder 44, which is driven synchronously with the continuous web 05. As represented in FIG. 3, the phase information I can be advantageously obtained directly at the cutter cylinder 44 by the use of an appropriate detection system 40, such as, for example, by the use of a sensor working together with an initiator, which is connected, fixed against relative rotation, with the cutter cylinder 44. In this case, for example, the initator is located in a fixed, exactly selected angular relationship of correct registration with the first cutting device 11 in regard to the cutting operation, so that cutting, by the use of the cutting device 11, takes place on the basis of a pulse when the initiator passes the sensor.

In an embodiment which is represented by dashed lines in FIG. 3, the phase information I can also be derived from the guide shaft of the machine control device 18, since the phase relation of the latter is correlated with the phase relation of the folding apparatus F, and in particular, with the phase relation of the transverse cutting device 24, in a defined manner.

The signal with the phase information I, in the form of angle information I, or in the form of a singular pulse at the time of the passage of the initiator, is processed in a control arrangement 56 and triggers the cutting at the correct registration by operation of the cutting device 11. In the case of an already phase-correlated singular pulse, the control arrangement 56 can be embodied as a simple actuating member 56, such as, for example, as a valve for a pressure medium charge. If the phase information I merely represents information regarding the angular position at the moment, the control arrangement 56 has means, such as, for example, input means for determining a defined set point position and for the respective evaluation of the received phase information I.

In the discussion which now follows, the guide rails 09, or the differently configured guide rail sections used in this connection, will be explained in greater detail.

Figure 4:
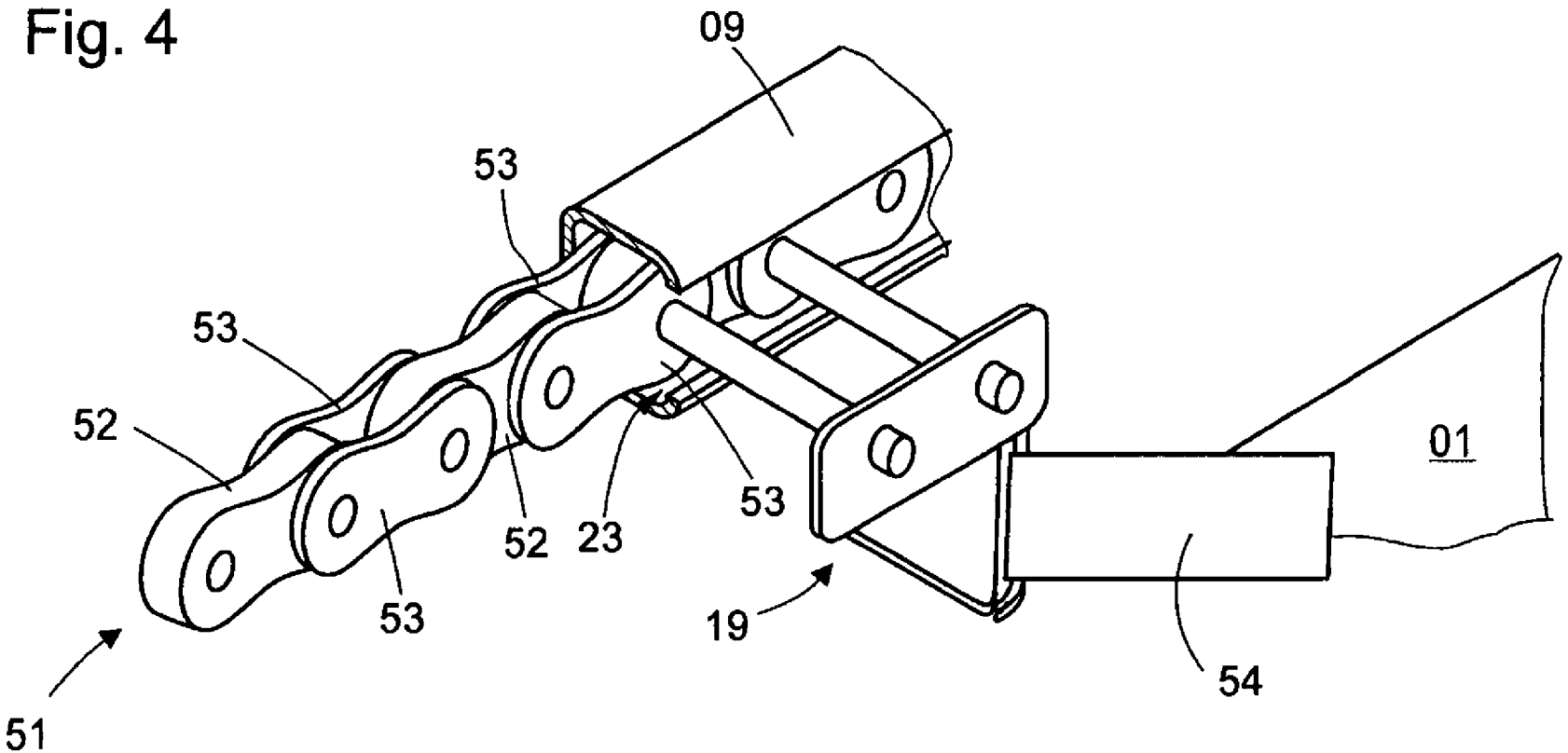
Figure 5:
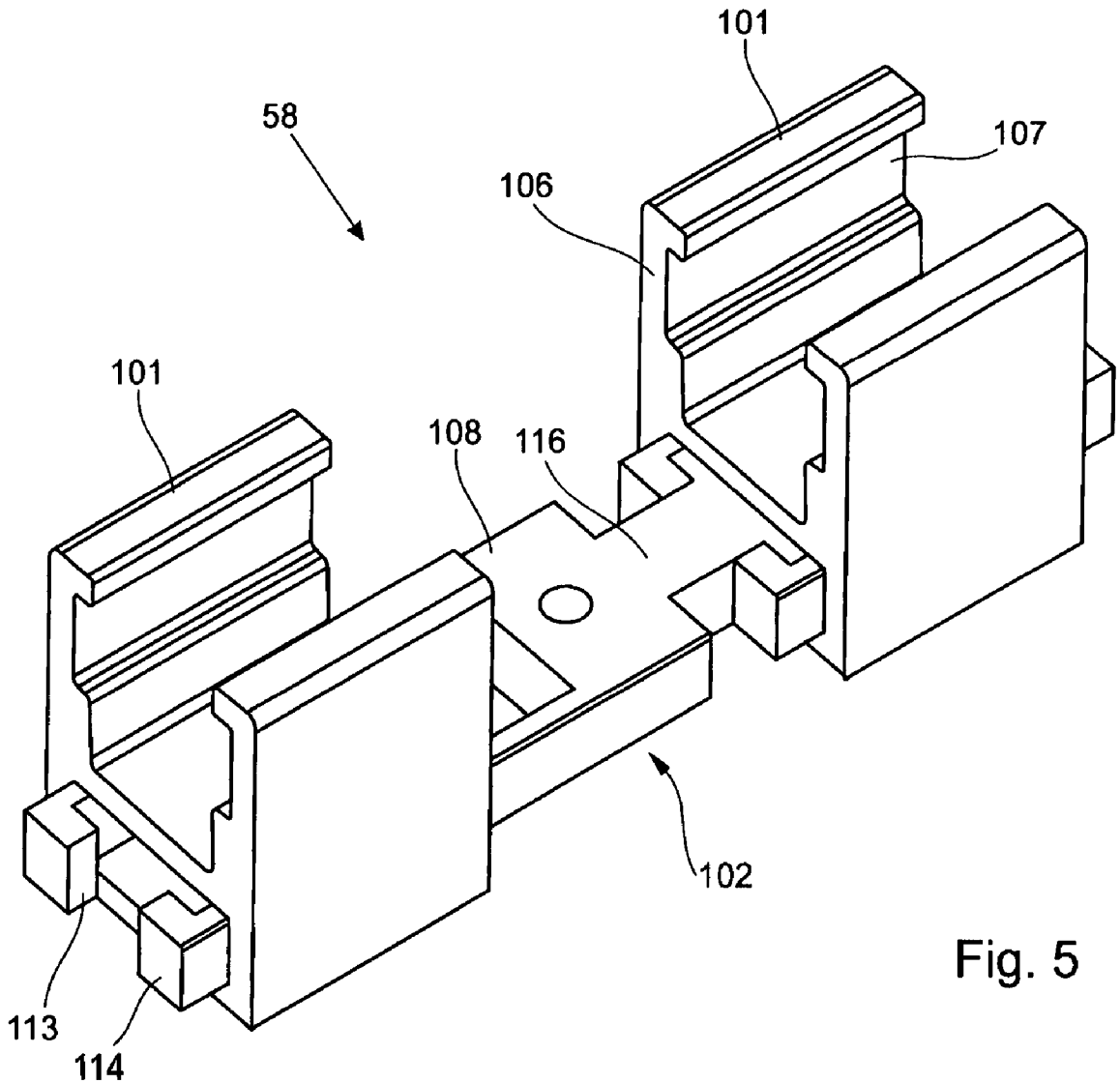
Figures 9, 10:
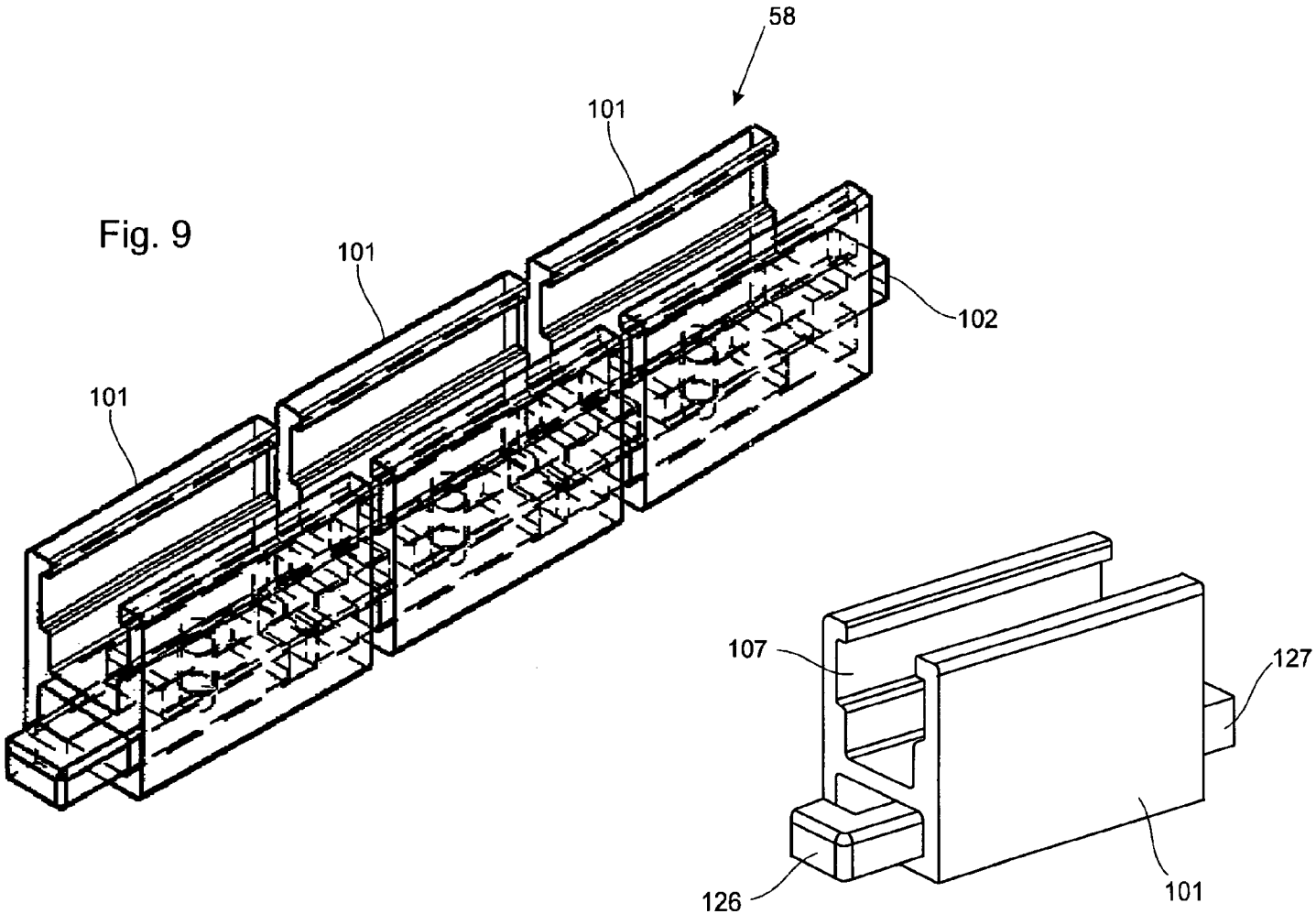
Figure 11:
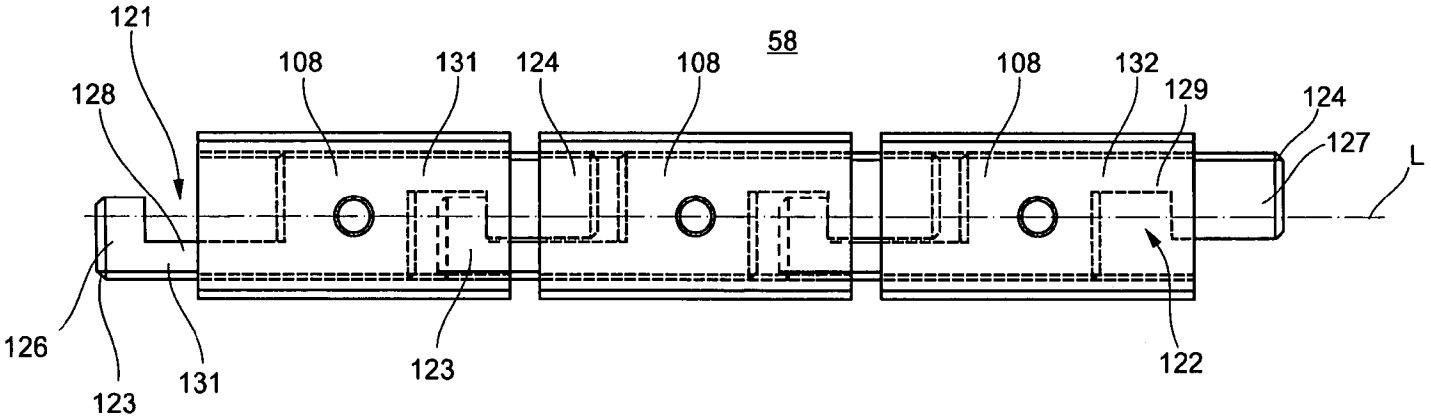
Figure 12:
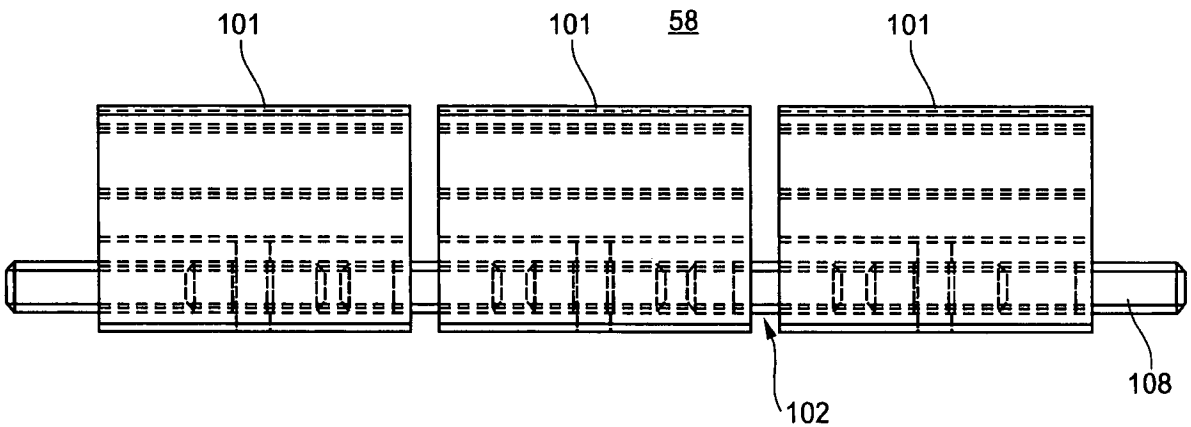
Figure 13:
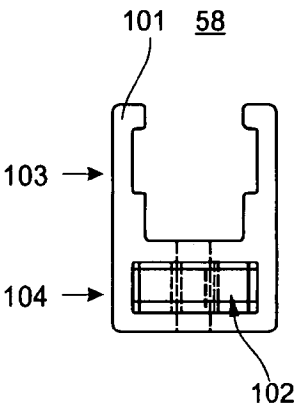

The guide rail 09, which is depicted somewhat schematically in FIGS. 1 and 2 and which is substantially employed primarily over the entire guide path has, as is represented in FIG. 4, a generally U-shaped or C-shaped cross section. This cross section defines a groove 23, as is also seen in FIG. 4 and through which groove 23, and in particular through longitudinal groove 23, respective chain elements 51 are conducted. The chain element 51 is constructed of alternatingly single- or double-segmented chain links 52, 53, at least one of which has an arm 19 extending out of the groove 23. In FIG. 4, two adjoining links 53 support an arm 19 together in cooperation with each other. The chain element 51 and the arm 19 will also be referred to as holding element 51, 19. A hook is provided at the end of the arm 19 remote from the chain 51, and is usable for fastening, with the aid of a loop placed around the hook, a leading edge 54 of a paper web 01 to be newly drawn in, or a draw-in tip connected with the leading edge 54.

The single-segmented links 52 are elastic per se, for example because they are made as one piece from an elastic material, or because they have an elastic center piece of spring steel or the like, which is not specifically represented in FIG. 4. In this way, these single segment elastic links 52 make possible the twisting of the chain element 51 around an axis which is extending parallel with respect to the longitudinal direction of the guide rail 09, and also make possible the bending of the chain element 51 around an axis which is perpendicular with respect to the plane of the paper web 01 that is to be drawn in.

Motors, which are not specifically represented, are arranged at uniform spacings along the guide rail 09, each of which motors supports a chain wheel which chain wheel enters into the groove 23 of the guide rail 09, through a gap in the side of the guide rail 09, and possibly also enters between the links 52, 53 of a chain element 51 that is located in the guide rail 09 at the position of the chain wheel. The length of the chain element 51 has been selected to be slightly greater than the spacing between each two successive chain wheels located sequentially along the guide rail 09, so that there is always at least one chain wheel in engagement with the chain element 51, when the chain element 51 is conveyed along the guide rail 09. The at least one chain wheel thus drives the chain element 51. For use in drawing in a paper web 01, it is therefore sufficient to fasten the paper web's leading edge 54 to the respective arm 19 of a chain element 51, which arm 19 is protruding from the groove 23, and thereafter to put the chain element 51 into motion along the guide rail 09 in order to draw in the paper web 01.

The guide rail 09, as described above, is twisted by about 90° in the area of the former 08. The direction of travel of the paper web 01, or of the continuous web 05, which has been put together from several individual paper webs 01, is changed at a former inlet roller 10, as is seen in FIG. 1, and reaches the slanting surface of the former 08, which former slanting side surface comes to a point at the bottom of the former 08. While the continuous web 05 is pulled over the lateral edge of the former 08, its orientation changes. An orientation of the web 05 upstream of the former inlet roller 10, which is substantially perpendicular with respect to the plane of FIG. 1 becomes an orientation substantially perpendicular with respect to the plane of FIG. 2 as the web 05 is formed. In order to be able to guide the paper web 01 through this change in orientation, the guide rail 09 is twisted by 90° in a section following the former inlet roller 10, as can be seen in FIG. 2. After passage of at least the web 05 through the former inlet roller 10, the groove 23 of the guide rail 09, as is depicted somewhat schematically in FIG. 2, initially still faces the former inlet roller 10, and the arm 19 of a holding element 51, 19 projects out of the groove 23 in the direction toward the former inlet roller 10 and parallel to an axis of rotation of the former inlet roller 10. After the twisted section of the guide rail 09 has been passed, the orientation of the chain element 51 is rotated by 90°. By the twisting of the guide rail 09 through generally 90° it is achieved that the paper webs 01 are still exactly guided, even after passage through the former 08.

Since, as has already been mentioned above, it is intended to process paper webs 01 of different widths by use of the folding apparatus F, it is important for interference-free operation that these paper webs 01 of possibly differing widths pass through the transverse cutting device 24 and the subsequent transverse folding arrangement exactly centered with respect to a longitudinal axis of, for example, the cutter cylinder 44 and the transport cylinder 38 and the folding jaw cylinder 43. To this end, the ability to displace the former 08 in a direction that is parallel in respect to the axes of rotation of the cylinders 38, 44, or of the cutting direction of the transverse cutting device 24, is required, as was previously mentioned in connection with FIGS. 1 and 2. To make this transverse displacement possible, the guide rail 09 can be telescopically pulled out in an area 57, as seen in FIG. 1, between the turning deck 06 and the compensation rollers 07, or its length can be changed in any other suitable way. Its shape can also be varied, following the former 08, in the area 58 marked by the dash-dotted circle 58 depicted in FIG. 1. in particular, the guide rail 09 is configured to be variable in length and to also be flexible, so as to make possible the smooth passage of the holding elements 51, 19 through the machine as far as the storage device 16, in any position the former 08 can take up. These areas of variable shape 57, 58 are each constituted by guide rail sections 57, 58 of variable shape, which variable shape guide rail sections 57, 58 have been inserted into the guide rail 09 and which will be described, in greater detail, in the subsequent discussion.

First, reference is made to the preferred embodiment in accordance with FIGS. 5 to 8. It should be pointed out that, for the purpose of clarifying the representation, the center guide element 101, which is represented in FIGS. 6 and 7, is not shown in FIG. 5.

The guide rail section 58 of variable shape, as depicted in FIGS. 5 to 8, is comprised of a plurality of guide elements 101, which are supported, and in particular which are fastened, placed one behind the other in the longitudinal direction, on a support strip 102. These plurality of guide elements 101 and support strip 102 together form a U-shaped, or a C-shaped rail for a draw-in device, which is not specifically represented in FIGS. 5 to 8, in particular a roller chain such as the roller chain shown at 51 in FIG. 4.

The guide elements 101 have a generally known cross section, such as is depicted particularly clearly in FIG. 8, and which cross section otherwise preferably corresponds to the cross section of the guide rails 09 shown in FIG. 4 and which are not constructed to have a variable shape, which are conventionally used in the machine shown in FIGS. 1 and 2. The guide elements 101, which are configured as profiled strips 101, or as profiled strip elements 101, each have a rectangular-shaped exterior cross section and can be made of metal, and in particular can be made of aluminum, but also could be made of a fiber-reinforced plastic material or of a composite material.

Each guide element 101 has a guide section 103 for use in guiding the draw-in arrangement, such as the chain element 51 which is not specifically represented, and a fastening section 104 for use in fastening the guide element on the support strip 102. In the case of the preferred embodiment depicted in FIGS. 5 to 8, the fastening section 104 is formed by a hollow profiled section 104. An interior cross section of the hollow profiled section 104 is shaped substantially rectangularly. In an assembled functional state of the variable shape guide rail section 58, the fastening section 104, or the hollow profiled section 104, completely extends around the support strip 102, so that the support strip 102 is guided, or is received, in the hollow profiled sections 104 of the support elements 101.

The guide section 103 has a generally U- or C-shaped cross section, and is substantially open on one side. The opening of the guide section 103 opens or extends in a direction away from the fastening section 104. The guide section 103 of each guide element 101 has two generally parallel, spaced legs 106, extending away from the hollow profiled section 104 and at right angles thereto. A groove 107 is formed on an inner face of each leg 106, so that the facing grooves 107 define a runway for the rollers of a roller chain.

The support strip 102 is configured to be variable in shape, and in particular to be variable in length, and/or able to be curved. It is possible to give the support strip a suitable variability of shape, such as, for example, through the selection of a suitable material, and in particular through the selection of an elastically deformable material, primarily a suitable plastic material, or a caoutchouc material. By the provision of this material, it is possible to achieve a twisting capability and a curving capability which, in particular, is sufficient for actual use.

In order to also be able to provide a sufficient length variability capability, the support strip 102 is constituted of a plurality, or of a multitude, of support elements 108, which are arranged one behind the other, viewed in the longitudinal direction L of the guide rail section 58, and which support elements 108 work together in the manner of links. Adjoining support elements 108 are connected at variable spacings in the longitudinal direction L, and in particular, engage each other with play. Thus, the individual support elements 108 can be pushed together or can be pulled apart, in relation to each other, so that the length of the support strip 102 can be changed in that way.

A guide element 101 is assigned to each support element 108, so that, respectively, one guide element 101 is fastened to respectively one support element 108. The length of each of the guide elements 101 is selected to be a function of the length of each of the support elements 108, preferably in such a way that, and considering also making use of the play provided, the guide elements 101 rest with their front faces abutting against each other when the support strip 102 has been completely pushed together. The sum of the lengths of the guide elements 101 therefore corresponds to the minimum length of the support strip 102 assigned to these guide elements 101, and the maximum length of the variable shape guide rail section 58 results from adding the sum of the play of the assigned support elements 108.

The individual support elements 108 are embodied to each be approximately plate-shaped and basically each have an overall cross section corresponding to the interior cross section of the hollow profiled sections 104 of the guide elements 101, such that a displacement of the support elements 108 within the hollow profiled sections 104 is possible. In the case of the present preferred embodiment, the cross section of each of the support elements 108 is substantially rectangular so as to match the interior cross section of the hollow profiled sections 104 of the guide elements 101.

Successive support elements 108 are coupled to each other so that their respective spacing can be varied. Successive or adjoining support elements 108, in particular, engage each other with play. To this end, each plate- shaped support element 108 has a C-shaped opening 109 of rectangular interior cross section at its one end, as may be seen in FIG. 6, which opening 109 is arranged centered, i.e. symmetrically with respect to the longitudinal direction L. At its other end, each support element 108 has a T-shaped shoulder 111, also arranged centered, i.e. symmetrically with respect to the longitudinal direction L. The T-shaped shoulder 111 of each support element 108 engages, and is received in, the C-shaped opening 109 of the respectively adjoining support element 108, also as seen in FIG. 6 with sufficient longitudinal play in such a way that adjoining support elements 108 can be shifted relatively to each other in the longitudinal direction L.

The width of the opening 109 in each support element 108, measured transversely to the longitudinal direction L, corresponds to the width of a transverse leg 112 of the T-shaped shoulder 111. The length of the opening 109, measured in the longitudinal direction L of the support element 108, is greater than the thickness of the transverse leg 112, also in the longitudinal direction L, because of which, the play between the support elements 108 is provided. In a direction toward the end of each respective support element 108, each opening 109 is delimited by, or is defined by, two end legs 113, 114 having leg ends pointing toward each other, and between which leg ends of legs 113 and 114 a longitudinal leg 116 of the T-shaped shoulder 111 is conducted, and whose mutual spacing distance corresponds to a transverse thickness of the longitudinal leg 116.

In the representation of the variable shape guide rail section 58, in accordance with FIG. 6, the support elements 108 can be put together in a direction perpendicular to the drawing plane. Then, guide elements 101 are pushed onto the now assembled support elements 108, over their hollow profiled sections 104, and are each fastened on a respective one of the support elements 108 in a manner to be described subsequently. As is clear from a review of the drawing figures shown in FIGS. 5 to 8, the guide elements 101 each extend at least partially around the respective support elements 108 in the area of the coupling, or connection, and specifically in the area of the opening 109 and the transverse leg 112 of the shoulder 111, because of circumextension which, this connection is secure from inadvertently becoming or being released.

In the case of the preferred embodiment depicted in FIGS. 5 to 8, a locking element 117, and in particular a locking bolt 117, is provided as the mechanism 117 for fixing a guide element 101 in place on a support element 108. Each locking bolt 117 is passed through aligned bores 118 and 119 in the support element 108, or in the fastening section 104 of the guide element 101, and can be fixed in place, in this position, in a positive or in a non- positive manner. It is possible, in particular, to embody the locking bolt 117 as a screw bolt 117, and a bore 119 in the fastening section 104 of the guide element 101, or a bore 118 in the support element, as threaded bores 118, 119.

A second preferred embodiment, in accordance with FIGS. 9 to 15, differs from the above described first preferred embodiment only with respect to the different configuration, or the shape, of the connection between the support elements 108, as is described in what follows. Otherwise, reference is made to the above description.

In the second preferred embodiment, as seen in FIGS. 9 to 15, the plate-like support elements 108 have L-shaped or angular-shaped cutouts 121, 122 at opposite ones of each of their respective ends. These cutouts 121, 122 are embodied in such a way that hook-shaped coupling shoulders 123,124 are formed at both ends of each support element 108, at respectively oppositely located sides. These coupling shoulders 123, 124 are oriented opposite or facing each other, so that the coupling shoulder 123 of one support element 108 works together, with play, with the coupling shoulder 124 of the adjoining support element 108.

The play between adjacent ones of the support element 108 is provided for because the thickness of a hook element 126 or 127, which is extending transversely with respect to the longitudinal direction L and which is formed at the end of the respective coupling shoulder 123 or 124 is less than the length, measured in the longitudinal direction L, of a leg 128, 129 of the respective cutout 121, 122 which is working together with the respective hook element 126, 127.

The hook-shaped coupling shoulders 123, 124 are furthermore configured in such a way that the free ends of the hook elements 126, 127 are supported at the respective longitudinal strip 131, 132 of the respective coupling element 123 or 124. This cooperative configuration aids the stability of the support strip 102.

The hook element 127 and the associated leg 128 of the first cutout 121 are wider than the hook element 126 and the associated leg 129 of the second cutout 122. This configuration insures that both cooperating coupling elements 123, 124 are guided in both associated guide elements 101, or in their hollow profiled sections 104, 104, even in case of the greatest possible stretching of the support strip 102. This is true, even in cases in which the individual guide elements 101 are maximally spaced apart and the gap between adjoining guide elements 101 has therefore attained its maximum size. In this context, see, for example, FIG. 7. This structure also contributes to the stability of the support strip.

Figure 14:
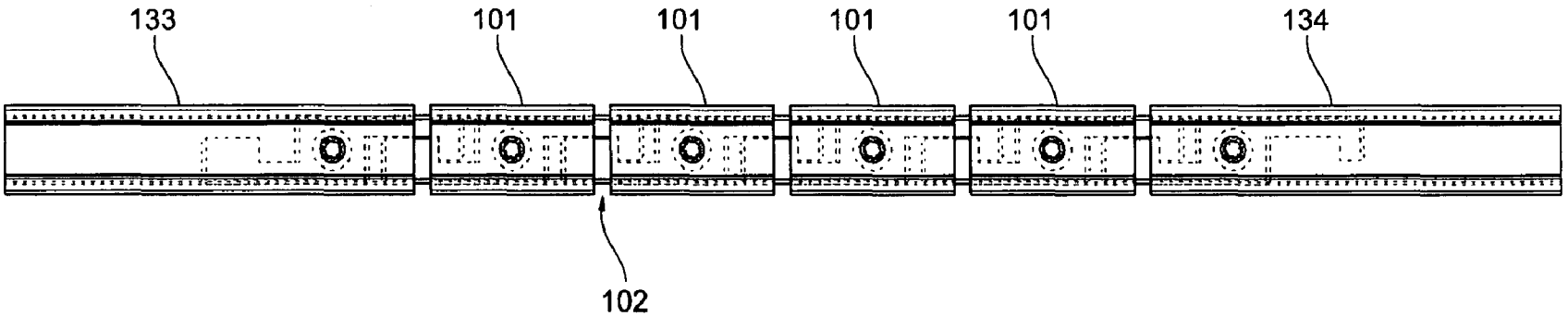
Figure 15:
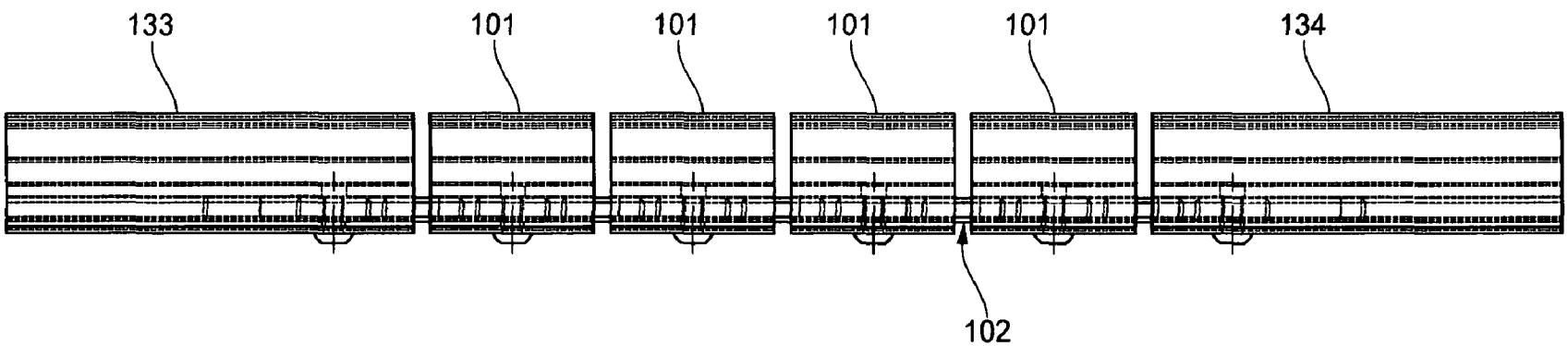

In accordance with the depiction of the present invention, as shown in FIGS. 14 and 15, the support strip 102 is connected, at both its ends, with a respective one of a guide segment 133 or 134, each of whose cross section corresponds to that of the guide elements 101, but which has a length in the longitudinal direction L that is longer than the length of each of the guide elements 101. The guide elements 133, 134 are connected with the guide rails 09. In an actual use configuration, linear variability can amount to 3 mm per coupling, for example. In the case of the example shown in FIGS. 14 and 15 this linear variability can amount to a total of 15 mm.

Figure 16:
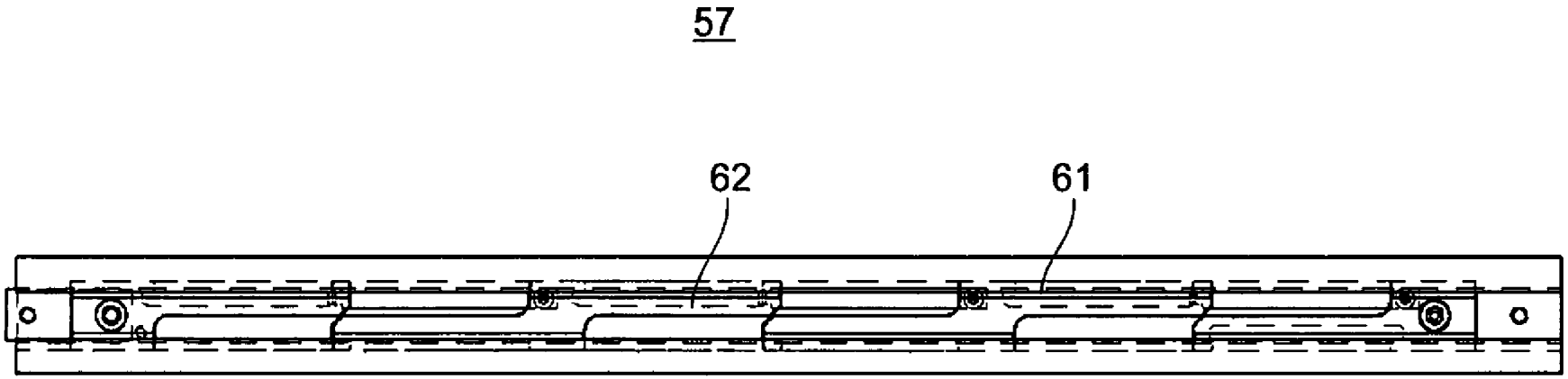

A further preferred embodiment of a guide rail section 57 of variable shape is shown in greater detail in FIG. 16. This third preferred embodiment of a guide rail section 57 is configured to be variable in length, or it can be telescopically extended. It is configured substantially in the arrangement disclosed in WO 98/50234 A1; the disclosure of which is expressly incorporated herein by reference.

The guide rail section 57 shown in FIG. 16 also has a C-shaped or a U-shaped interior cross section and is comprised of partial elements 61, 62. These engage each other in a relatively displaceable manner and always maintain a positive guidance of the roller chain 51.

It is to be understood that in place of a length-variable guide rail section 57 in the area 57 it would also be possible to employ a guide rail section 58 of variable shape, such as the one shown in FIGS. 5 to 8 or FIGS. 9 to 15. Also, guide rail sections 57, 58 of variable shape can additionally be employed at other locations, if needed.

Figure 17:
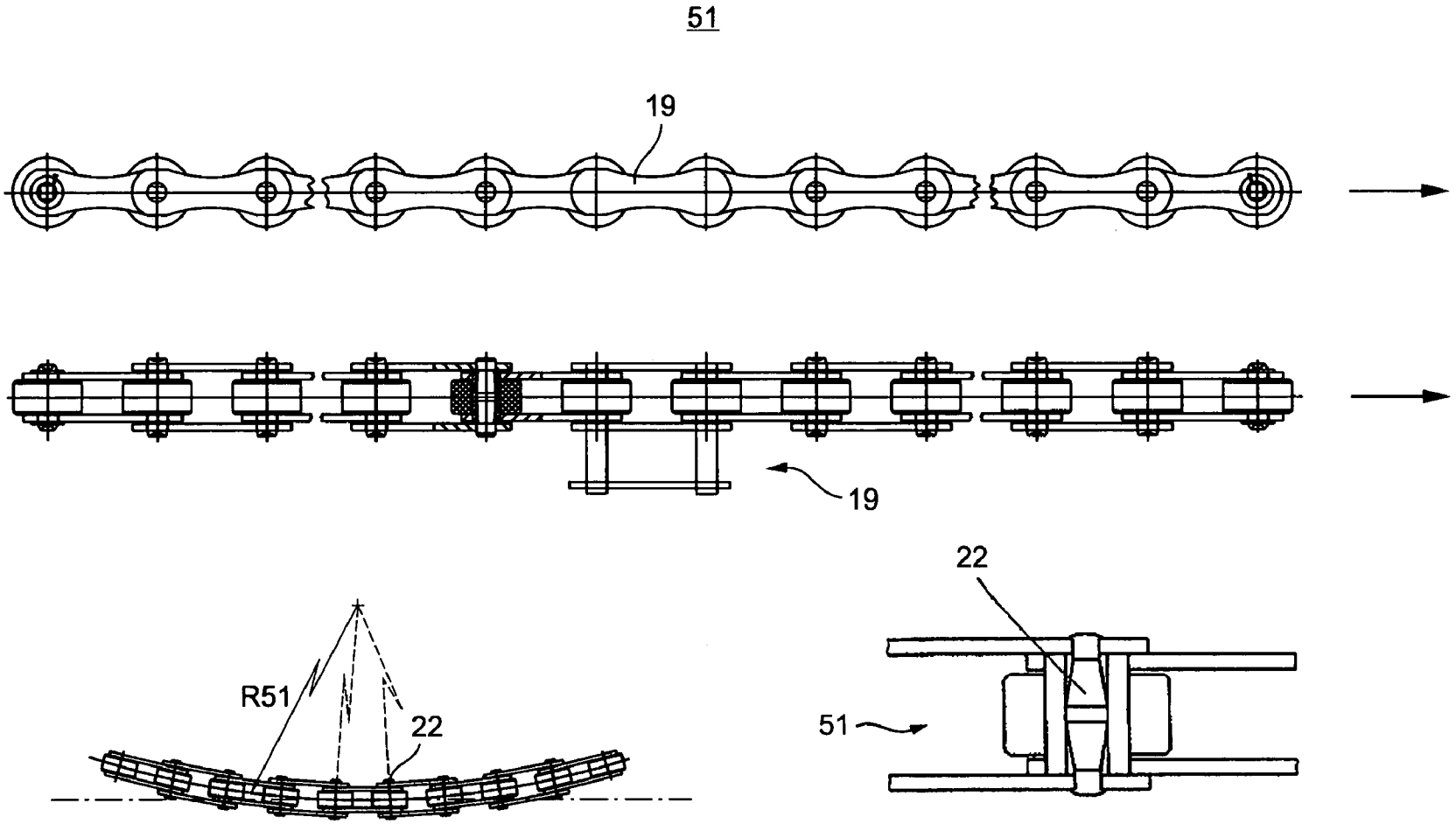

An advantageous embodiment of the chain 51 which is intended to be conducted in the guide rail 09, or in the guide rail sections 57, 58, is represented in FIG. 17. The chain 51 has rollers, respectively seated on pins 22. The pins 22 are connected, spaced apart, by the use of tongues. To insure that the chain 51 can perform more than solely a pivot movement around the longitudinal axis of the pins 22, the bores in the tongues are slightly larger, for example, than are the diameter of the pins 22. The result is that the chain 51 can be curved transversely to the running direction, or to the longitudinal axis direction, of the pins 22. A maximum radius of curvature R51 of the chain of 1,000 mm, but preferably less than 600 mm, and particularly preferred less than 500 mm, results in the curved state of the chain 51.

It is also possible to configure the pin 22 with different diameters in its longitudinal direction, in particular to configure the pin 22 to be crowned.

It should be pointed out that in order to be able to process several webs of material in a bundled or superimposed or layered manner, the superstructure of the folding apparatus has several selectable, alternative paths, on each of which respectively at least one web 01 of material can be guided through the superstructure 03 and to the transverse cutting device 24. In a manner, which is not specifically shown in detail, several rail sections, which are each extending along each one of these paths, are capable of being united with the guide rail 09 upstream of the transverse cutting device 24.

While preferred embodiments of a device and a method for feeding at least one material web or web strand into a folding device, in accordance with the present invention, have been set forth fully and completely hereinabove, it will be apparent to one of skill in the art that various changes in, for example, the drive assembly for the draw-in chains, the attachment of the web leading end to the draw-in device, the specific structure of the superstructure and the like could be made without departing from the true spirit and scope of the present invention which is accordingly to be limited only by the appended claims.

What is claimed is:

1. A device for drawing in at least one web of material into a folding apparatus comprising:

a superstructure in said folding apparatus;

at least one former in said folding apparatus said at least one former having a former inlet and a former outlet and at least one former lateral edge, said at least one former being movable relative to a direction of travel of the web of material through said folding apparatus, said at least one former being located after said superstructure in said direction of web travel and being usable to longitudinally form said at least one web of material;

a transverse cutting apparatus located after said former outlet of said at least one former, in said direction of web travel, said transverse cutting apparatus being adapted to separate said at least one web of material into individual products;

at least one guide rail, said at least one guide rail extending through said superstructure and past said former along a path of web travel through said former and at a level of said former, said at least one guide rail being parallel to said lateral edge of said at least one former and spaced from said at least one former;

at least one web leading end holding device adapted for travel along said at least one guide rail along said path of web travel; and at least first and second variable shape guide rail sections in said at least one guide rail, said first variable shape guide rail section being located before, in said direction of web travel, said former inlet, said second variable shape guide rail section being located after, in said direction of web travel, said former outlet, said second variable shape guide rail section extending, in said direction of web travel from said former outlet toward said transverse cutting apparatus, said guide rail being twisted at said level of said former and between said first variable shape guide rail section and said second variable shape guide rail section, a position of said guide rail being matched to a position of said at least one movable former.

2. The device of claim 1 wherein at least one of said first and second variable shape guide rail sections is variable in length.

3. The device of claim 1 wherein at least one of said first and second variable shape guide rail sections is twistable.

4. The device of claim 1 wherein at least one of said first and second variable shape guide rail sections is curvable.

5. The device of claim 1 wherein said at least one web leading end holding device includes a finite chain.

6. The device of claim 5 wherein said finite chain can be curved transversely in said direction of web travel.

7. The device of claim 5 wherein said finite chain includes chain rollers having longitudinal shafts, virtual extensions of said longitudinal shafts, when said chain is curved, defining a radius of curvation of said chain of less than 1000 mm.

8. The device of claim 7 wherein said radius of curvation is less than 600 mm.

9. The device of claim 1 wherein said first variable shape guide rail section is variable in length.

10. The device of claim 1 further including means providing a signal representative of a phase position of said transverse cutting apparatus, said signal being adapted to actuate said first cutting device in a phase-correlated position with respect to said phase position of said transverse cutting apparatus.

11. The device of claim 1 further including a first web cutting device between said former outlet and said transverse cutting device and wherein said first web cutting device includes at least one cutting element supported for movement along a substantially linear actuating path.

12. The device of claim 11 further including a second web cutting device between said first web cutting device, and said transverse cutting device, wherein said second web cutting device is adapted to cut said web in response to an emergency stop signal for said folding apparatus and further wherein said guide rail includes a guide rail section which extends between said first web cutting device and said second web cutting device.

13. The device of claim 12 further including a web leading end holding device storage area adjacent said guide rail section extending between said first and second cutting devices.

14. The device of claim 13 wherein said holding device storage area is a further guide rail section.

15. The device of claim 14 wherein said further guide rail section extends away from said web of material in a lateral direction.

16. The device of claim 13 further including a return guide rail extending generally opposite to said direction of said travel, said storage device being connected to said return guide rail.

17. The device of claim 1 further including a roll changer in a printing group located before, in said direction of web travel, said superstructure, said guide rail extending continuously from said roll changer to said former.

18. The device of claim 17 further including at least first and second roll changers and wherein a separate guide rail extends from each said roll changer.

19. The device of claim 1 wherein said at least one former lateral edge is inclined at an acute angle with respect to said web transport direction.

20. The device of claim 1 wherein said at least one former is movable in said web travel direction.

21. The device of claim 1 wherein said at least one former is movable in a transverse direction with respect to said direction of web travel.

22. A device for drawing in at least one web of material into a folding apparatus comprising:

a superstructure in said folding apparatus;

at least one former in said folding apparatus, said at least one former being movable relative to a direction of travel of the web of material through said folding apparatus and being located after said superstructure in said direction of web travel;

a transverse cutting apparatus after said at least one former in said direction of web travel, said transverse cutting apparatus being adapted to separate said web of material into individual products;

at least one guide rail, said at least one guide rail extending through said superstructure and past said former and at a level of web travel;

at least one web leading end holding device adapted said at least one guide rail along said path of web travel; and at least first and second variable shape guide rail sections in said at least one guide rail, said first variable shape guide rail section being located before, in said direction of web travel, said former, said second variable shape guide rail section being located after, in said direction of web travel, said former, each of said at least first and second variable shape guide strip sections including a variable shape support strip and a plurality of guide elements, said plurality of guide elements defining a path of said travel of said at least one web leading end holding device.

23. The device of claim 22 wherein said support strip includes a plurality of support strip elements arranged one after the other in said direction of web travel.

24. The device of claim 23 wherein adjacent ones of said plurality of support strip elements are coupled to each other.

25. The device of claim 23 wherein each said support strip element supports one of said plurality of guide elements.

26. The device of claim 23 wherein said plurality of support strip elements are engagable with each other in a direction substantially perpendicular to said direction of web travel.

27. The device of claim 23 wherein said plurality of guide elements extend around respective ones of said plurality of support strip elements in an area of coupling of adjacent ones of said plurality of support strip elements.

28. The device of claim 24 wherein said adjacent ones of said plurality of support strip elements are coupled to each other with variable spacing distances.

29. The device of claim 24 wherein said adjacent ones of said plurality of support strip elements are coupled to each other with variable spacings.

30. The device of claim 29 wherein each of said support strip elements includes a support strip element body having an opening at a first end and a shoulder of a second end, said shoulder of a first one of said support strip elements being receivable in said opening of an adjacent one of said support strip elements.

31. The device of claim 29 wherein each said support strip element includes a first hook-shaped coupling shoulder at a first end and a second hook-shaped coupling shoulder at a second end, said first and second shoulders being oriented in opposite directions with respect to each other.

32. The device of claim 30 wherein said shoulder in each said support strip element is T-shaped.

33. The device of claim 22 wherein said variable shape support strip is generally rectangular in cross-section.

34. The device of claim 22 wherein said variable shape support strip is made substantially of an elastically deformable material.

35. The device of claim 22 wherein said plurality of guide elements are individually fastened on said variable shaped support strip.

36. The device of claim 22 wherein adjoining ones of said plurality of guide elements are coupled with each other through said variable shape support strips.

37. The device of claim 22 wherein said plurality of guide elements are pushed onto said variable shape support strip.

38. The device of claim 22 further wherein each of said plurality of guide elements is substantially made of one of metal, fiber reinforced plastic and a composite material.

39. The device of claim 22 wherein each said guide element includes a guide section adapted to guide said at least one web leading end holding device, and a fastening section adapted to fasten each said guide element on said variable shape support strip.

40. The device of claim 39 wherein a cross-section of said guide section is substantially C-shaped having an opening facing away from said fastening section.

41. The device of claim 39 wherein said fastening section of each said guide element at least partially encloses said support strip.

42. The device of claim 41 wherein said fastening section includes a hollow profiled section having an interior cross-section matched to an exterior cross-section of said support strip.

43. The device of claim 22 wherein a sum of lengths of said plurality of guide elements corresponds to a minimum length of said support strip.

* * * * *